US009986353B2

(12) United States Patent
Puskarich

(10) Patent No.: US 9,986,353 B2
(45) **Date of Patent: *May 29, 2018**

(54) EARPHONES WITH EAR PRESENCE SENSORS

(71) Applicant: Apple Inc., Cupertino, CA (US)

(72) Inventor: Paul G. Puskarich, Palo Alto, CA (US)

(73) Assignee: Apple Inc., Cupertino, CA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/449,404

(22) Filed: Mar. 3, 2017

(65) Prior Publication Data

US 2017/0180898 A1 Jun. 22, 2017

Related U.S. Application Data

(63) Continuation of application No. 13/547,371, filed on Jul. 12, 2012, now Pat. No. 9,648,409.

(51) Int. Cl.

| | |
|---|---|
| ***H04R 29/00*** | (2006.01) |
| ***H04R 1/10*** | (2006.01) |
| ***H04R 5/04*** | (2006.01) |

(52) U.S. Cl.

CPC ..... *H04R 29/001* (2013.01); *H04R 1/1016* (2013.01); *H04R 1/1041* (2013.01); *H04R 5/04* (2013.01)

(58) Field of Classification Search

CPC .. H04R 1/1041; H04R 1/1016; A61B 5/6843; A61B 5/6844; G06F 3/0304

See application file for complete search history.

(56) References Cited

U.S. PATENT DOCUMENTS

| | | | |
|---|---|---|---|
| 3,794,779 | A | 2/1974 | Greuzerd et al. |
| 3,796,840 | A | 3/1974 | Ohta |

(Continued)

FOREIGN PATENT DOCUMENTS

| | | | |
|---|---|---|---|
| JP | H08195997 | A | 7/1996 |
| JP | H09253062 | A | 9/1997 |

(Continued)

OTHER PUBLICATIONS

"Method and System is Disclosed for Modifying Audio Channel Routing Based on Operational Condition Associated with One or More Audio Devices." Jul. 16, 2010 (3 pages).

(Continued)

*Primary Examiner* — Fan Tsang
*Assistant Examiner* — Angelica M McKinney
(74) *Attorney, Agent, or Firm* — Treyz Law Group, P.C.; G. Victor Treyz; Zachary D. Hadd

(57) ABSTRACT

An electronic device may be coupled to an accessory such as a pair of earphones. The earphones may have ear presence sensor structures that determine whether or not the ears of a user are present in the vicinity of the earphones. The earphones may contain first and second speakers. When both the first and second speakers are located in the ears of the user, the electronic device may perform functions such as playing audio content. When one of the speakers has been removed from the ears of the user while the other of the speakers remains in the ears of the user, the electronic device can take actions such as pausing the playback of audio content, switching from stereo to monophonic playback, or stopping the playback of content. Suitable actions such as increasing audio drive strength may be taken when both speakers have been removed from the ears.

12 Claims, 6 Drawing Sheets

(56) References Cited

U.S. PATENT DOCUMENTS 5,144,678 A 9/1992 Lenz
5,337,353 A 8/1994 Boie et al.
5,708,725 A 1/1998 Ito
5,729,604 A 3/1998 Van Schyndel
5,937,070 A 8/1999 Todter et al.
6,078,829 A * 6/2000 Uchida ..... A61B 5/02427 600/310
6,108,430 A 8/2000 Kurisu
6,118,878 A 9/2000 Jones
6,614,912 B1 9/2003 Yamada et al.
6,817,440 B1 11/2004 Kim
7,069,018 B1 6/2006 Granstam et al.
7,542,012 B2 6/2009 Kato et al.
7,925,029 B2 4/2011 Hollemans
8,019,096 B2 9/2011 Sander et al.
8,055,319 B2 11/2011 Oh et al.
8,199,956 B2 6/2012 Haartsen et al.
8,238,590 B2 8/2012 Burge
8,428,053 B2 4/2013 Kannappan
8,521,239 B2 8/2013 Hosoi et al.
8,945,177 B2 2/2015 Sanders
2002/0003889 A1* 1/2002 Fischer ..... H04R 1/1041 381/370
2004/0138723 A1 7/2004 Malick et al.
2005/0170859 A1 8/2005 Koike et al.
2005/0250553 A1 11/2005 Lim
2006/0013079 A1 1/2006 Rekimoto
2006/0233413 A1 10/2006 Nam
2006/0256133 A1 11/2006 Rosenberg
2007/0032731 A1 2/2007 Lovejoy et al.
2007/0076897 A1 4/2007 Philipp
2007/0085157 A1* 4/2007 Fadell ..... G06F 3/0304 257/428
2007/0121959 A1 5/2007 Philipp
2007/0169615 A1 7/2007 Chidlaw et al.
2008/0149417 A1 6/2008 Dinh et al.
2008/0157991 A1 7/2008 Raghunath et al.
2008/0158000 A1 7/2008 Mattrazzo
2008/0166002 A1 7/2008 Amsel
2008/0220831 A1 9/2008 Alameh et al.
2008/0303947 A1 12/2008 Ohnishi et al.
2009/0097689 A1 4/2009 Prest et al.
2009/0112696 A1 4/2009 Jung et al.
2009/0131124 A1 5/2009 Bibaud et al.
2009/0245549 A1 10/2009 Jubelirer et al.
2009/0285408 A1 11/2009 Kimura
2009/0305742 A1* 12/2009 Caballero ..... H04B 1/3838 455/566
2010/0020998 A1 1/2010 Brown et al.
2010/0022283 A1 1/2010 Terlizzi
2010/0079356 A1 4/2010 Hollewarth
2010/0109895 A1 5/2010 Rosener
2010/0128887 A1 5/2010 Lee et al.
2010/0183175 A1 7/2010 Chen et al.
2010/0019736 A1 8/2010 Namgoong et al.
2010/0197360 A1* 8/2010 Namgoong ..... H04M 1/6058 455/569.1
2010/0260362 A1* 10/2010 Sander ..... H04R 1/1041 381/309
2010/0303258 A1* 12/2010 Pan ..... G11B 27/10 381/104
2010/0310087 A1 12/2010 Tomomi
2010/0310097 A1 12/2010 Chang
2011/0021182 A1 1/2011 Huan
2011/0116643 A1 5/2011 Tiscareno et al.
2011/0144779 A1 6/2011 Janse et al.
2011/0187868 A1 8/2011 Chang et al.
2011/0188677 A1 8/2011 Rothkopf et al.
2011/0196519 A1 8/2011 Khoury et al.
2011/0275323 A1* 11/2011 Goldman ..... H04M 1/04 455/41.2
2011/0286615 A1 11/2011 Olodort et al.
2012/0086551 A1 4/2012 Lowe et al.
2012/0114154 A1 5/2012 Abrahamsson
2012/0207317 A1 8/2012 Abdollahzadeh Milani et al.
2012/0230699 A1 9/2012 Burnett
2012/0244917 A1 9/2012 Hosoi
2012/0281850 A1* 11/2012 Hyatt ..... H04R 1/1041 381/74
2013/0038458 A1 2/2013 Toivola
2013/0075595 A1 3/2013 Ruh
2013/0083933 A1 4/2013 Aase
2013/0094659 A1 4/2013 Liu
2013/0121494 A1 5/2013 Johnston
2013/0163783 A1 6/2013 Burlingame
2013/0236027 A1 9/2013 Tao
2013/0279724 A1 10/2013 Stafford et al.
2014/0146976 A1 5/2014 Rundle
2014/0146979 A1 5/2014 Puskarich
2014/0146982 A1 5/2014 Pelosi
2015/0358712 A1 12/2015 Ji

FOREIGN PATENT DOCUMENTS

JP 10028169 1/1998
JP 2002135887 A 5/2002
WO 2011146659 11/2011

OTHER PUBLICATIONS

Acker et al., "Smart Audio Output With Presence Sensors: Enabling Mode Switching Using Head Sets or Ear Buds" Synaptics Incorporated, San Jose, California, Nov. 2, 2005 (10 pages).
"Automated Play/Pause of Music Based on Aggregated Sensor Data," Feb. 2, 2012 (3 pages).
Free on iPhone: Free Apps, Review for iPhone, "iPhone Proximity Sensor", posted Jan. 2, 2009, retrieved Sep. 1, 2011.
Hisahiro Moriuchi "Universal Earphones: Earphones with Automatic Side and Shared Use Detection", 2012, 1 page.
Matsumura et al., "Universal Earphones: Earphones with Automatic Side and Shared Use Detection" IUI'12, Feb. 2012, Lisbon, Portugal. ACM 978-1-4503-1048-2/12/02.
Poh et al., "Heartphones: Sensor Earphones and Mobile Application for Non-obtrusive Health Monitoring" 2009 International Symposium on Wearable Computers, DOI 10.1109/ISWC.2009.35.
Aron, "Earphones that know when they're in the wrong ear" NewScientist.com, Feb. 1, 2012. <https://www.newscientist.com/blogs/onepercent/2012/02/universal-earphones-solve-your.html>.
Pollicino, "Parrot Zik by Starck review: Is $400 worth it for the fanciest, techiest headphones around?" Engadget.com, Aug. 2, 2012. <https://www.engadget.com/2012/08/02/parrot-zik-by-starck-review/>.
"Prototype Headphones Detect Which Ear They Are In" BBC.com, Mar. 8, 2012 <https://www.bbc.com/news/technology-16908936>.
Cooper, "Self-aware headphones switch channels depending on which ear they're in (video)" Engadget.com, Feb. 3, 2012. <https://www.engadget.com/2012/02/03/self-aware-headphones-switch-channels-depending-on-which-ear-the/>.
Shanklin, "Smart headphines make mixing up left and right a thing of the past" Geek.com, Feb. 3, 2012. <https://www.geek.com/gadgets/smart-headphones-make-mixing-up-left-and-right-a-thing-ofthe-past-1464919/>.
Burns, "Universial Earphones detect left and right ear placement" New Atlas, Feb. 5, 2012. <https://newatlas.com/universial-earphones-earbuds-left-right-channel-21331/>.
Matsumura, "Universal Earphones: Earphones with Automatic Side and Shared Use Detection" (Video), available online at <https://vimeo.com/36062219>, 2011, 1 page.

* cited by examiner

EARPHONES WITH EAR PRESENCE SENSORS

This application is a continuation of U.S. patent application Ser. No. 13/547,371, filed Jul. 12, 2012, which is hereby incorporated by reference herein in its entirety. This application claims the benefit of and claims priority to U.S. patent application Ser. No. 13/547,371, filed Jul. 12, 2012.

BACKGROUND

This relates to electronic devices and, more particularly, to electronic devices with accessories such as earphones.

Accessories such as earphones are often used with media players, cellular telephones, and other electronic devices. There can be difficulties associated with using earphones. For example, a user who is listening to audio content using earphones in both ears may occasionally need to remove one or both of the earphones. When doing so, the user may miss content that is being played. For example, if a user needs to momentarily remove earphones to talk to someone, the user may not be able to manually stop content playback before removing the earphones, causing some of the content to be played back without the user's full attention.

It would therefore be desirable to be able to provide improved ways in which to control operation of an electronic device coupled to an accessory.

SUMMARY

An electronic device may be coupled to an accessory such as a pair of earphones. The earphones may have ear presence sensor structures that determine whether or not the ears of a user are present in the vicinity of the earphones.

The earphones may contain first and second speakers. For example, the earphones may include a left earbud and a right earbud. When both the first and second speakers are located in the ears of the user, the electronic device may perform functions such as playing audio content. The audio content may be played in stereo using an audio signal strength appropriate for use when the speakers are located in the vicinity of the ears of the user.

When one of the speakers has been removed from the ears of the user while the other of the speakers remains in the ears of the user, the electronic device can take actions such as pausing the playback of audio content, switching from stereo to monophonic playback, or stopping the playback of content.

Suitable actions such as increasing audio signal strength may be taken when both speakers have been removed from the ears of the user.

Ear presence sensor structures may be formed from electrode structures. The electrode structures may be used to measure electrical resistance or capacitance. The electrode structures may be formed from a conductive mesh through which audio may pass.

Further features of the invention, its nature and various advantages will be more apparent from the accompanying drawings and the following detailed description of the preferred embodiments.

DETAILED DESCRIPTION

Electronic device accessories may be provided with the ability to sense the presence of external objects. For example, an earphone accessory may be provided with sensing structures that can determine whether or not the earphones (i.e., the earphone speakers) are located in the ears of a user.

Figure 1:
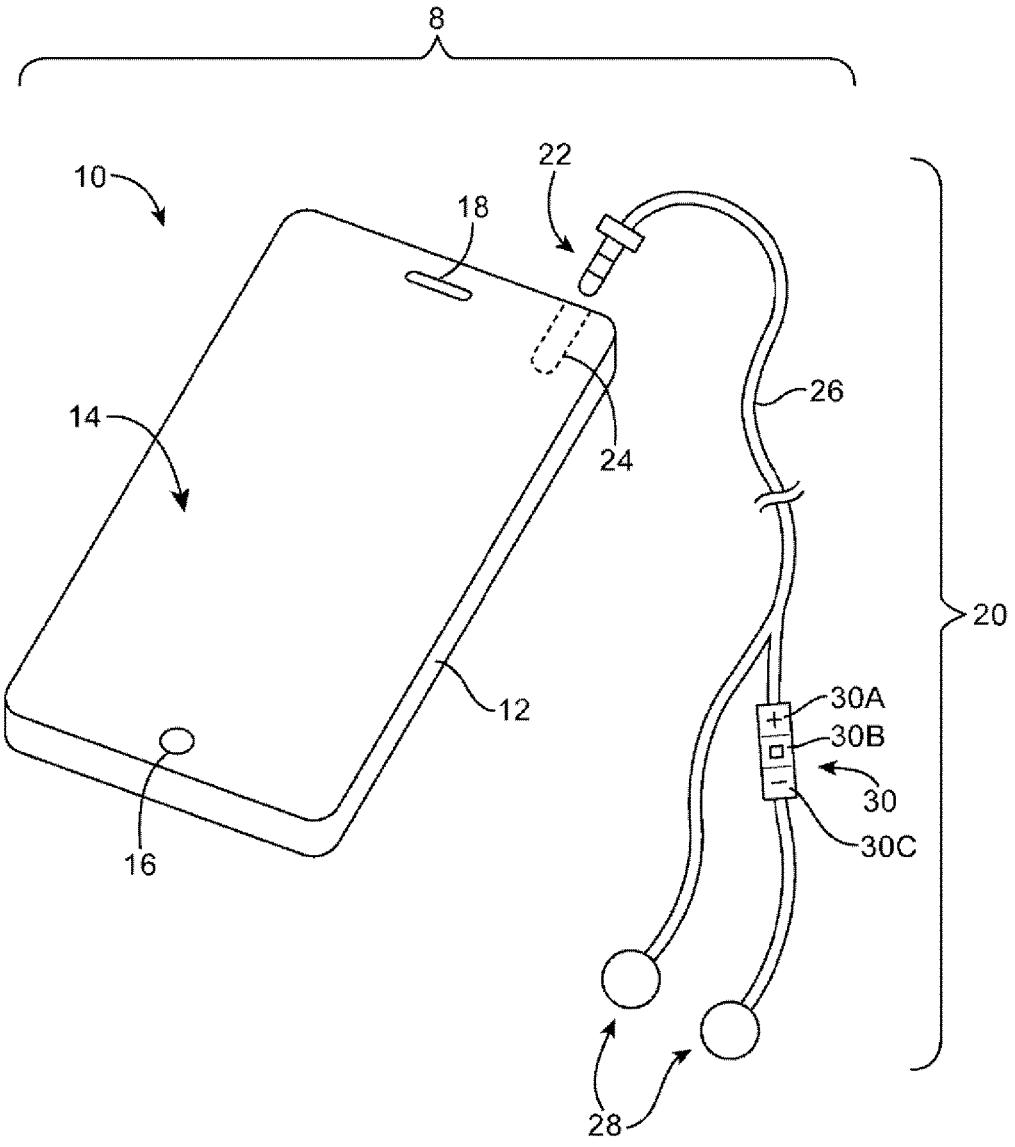
FIG. 1 is a front perspective view of an illustrative electronic device and associated accessory in accordance with an embodiment of the present invention.

FIG. 1 is a diagram of a system of the type that may be provided with an accessory having sensing structures for detecting the presence of external objects such as the ears of a user. As shown in FIG. 1, system 8 may include electronic device 10 and accessory 20.

Electronic device 10 may include a display such as display 14. Display 14 may be a touch screen that incorporates a layer of conductive capacitive touch sensor electrodes or other touch sensor components or may be a display that is not touch-sensitive. Display 14 may include an array of display pixels formed from liquid crystal display (LCD) components, an array of electrophoretic display pixels, an array of plasma display pixels, an array of organic light-emitting diode display pixels, an array of electrowetting display pixels, or display pixels based on other display technologies. Configurations in which display 14 includes display layers that form liquid crystal display (LCD) pixels may sometimes be described herein as an example. This is, however, merely illustrative. Display 14 may include display pixels formed using any suitable type of display technology.

Display 14 may be protected using a display cover layer such as a layer of transparent glass or clear plastic. Openings may be formed in the display cover layer. For example, an opening may be formed in the display cover layer to accommodate a button such as button 16 and an opening such as opening 18 may be used to form a speaker port.

Device 10 may have a housing such as housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials.

Housing 12 may be formed using a unibody configuration in which some or all of housing 12 is machined or molded as a single structure or may be formed using multiple structures (e.g., an internal frame structure, one or more structures that form exterior housing surfaces, etc.). The periphery of housing 12 may, if desired, include walls. One or more openings may be formed in housing 12 to accommodate connector ports, buttons, and other components. For example, an opening may be formed in the wall of housing 12 to accommodate audio connector 24 and other connectors (e.g., digital data port connectors, etc.). Audio connector 24 may be a female audio connector (sometimes referred to as an audio jack) that has two pins (contacts), three pins, four pins, or more than four pins (as examples). Audio connector 24 may mate with male audio connector 22 (sometimes referred to as an audio plug) in accessory 20.

Accessory 10 may be a pair of earphones (e.g., earbuds or earphones with other types of speakers), other audio equipment (e.g., an audio device with a single earbud unit), or other electronic equipment that communicates with electronic device 10. The use of a pair of headphones in system 8 is sometimes described herein as an example. This is, however, merely illustrative. Accessory 10 may be implemented using any suitable electronic equipment.

As shown in FIG. 1, accessory 20 may include a communications path such as cable 26 that is coupled to audio plug 22. Cable 26 may contain conductive lines (e.g., wires) that are coupled to respective contacts (pins) in audio connector 22. The conductive lines of cable 26 may be used to route audio signals from device 10 to speakers in earphone units 28. Earphone units 28 (which may sometimes be referred to as speakers or earphone housings) may include sensor structures for determining when earphone units 28 have been placed within the ears of a user. Microphone signals may be gathered using a microphone mounted in controller unit 30. Controller unit 30 may also have buttons that receive user input from a user of system 8. A user may, for example, manually control the playback of media by pressing button 30A to play media or increase audio volume, by pressing button 30B to pause or stop media playback, and by pressing button 30C to reverse media playback or decrease audio volume (as examples).

The circuitry of controller 30 may communicate with the circuitry of device 10 using the wires or other conductive paths in cable 26 (e.g., using digital and/or analog communications signals). The paths in cable 26 may also be coupled to speaker drivers in earphones 28, so that audio signals from device 10 may be played through the speakers in earbuds 28. Electronic device 10 may regulate the volume of sound produced by earbuds 28 by controlling the audio signal strength used in driving the speakers in earbuds 28.

Sensor signals from sensor structures in earbuds 28 may be conveyed to device 10 using the conductive paths of cable 26. Electronic device 10 may process the sensor signals and take suitable action based on a determination of whether or not one or both of earphones 28 is in use in a user's ears.

Figure 2:
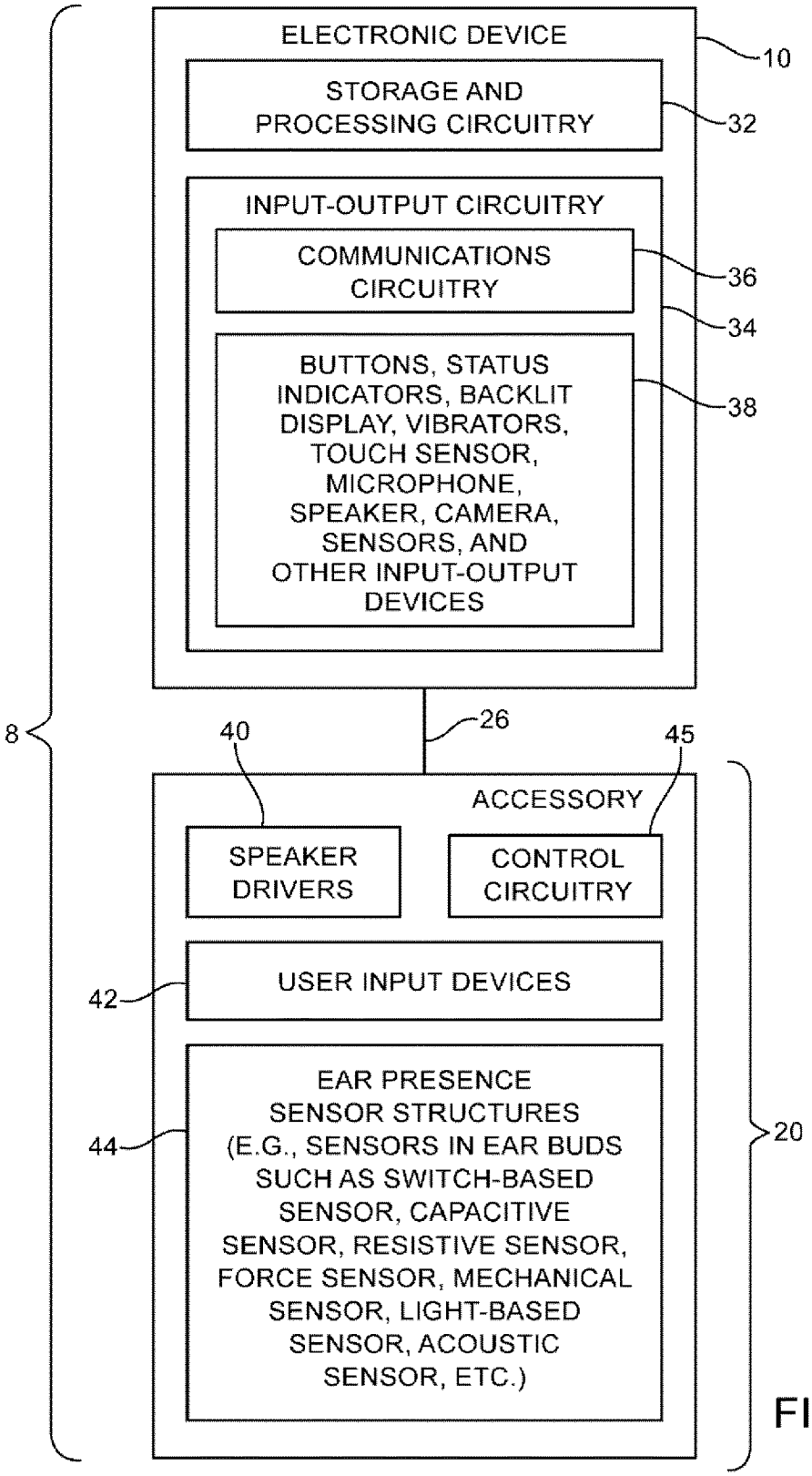
FIG. 2 is a schematic diagram of an illustrative electronic device in accordance with an embodiment of the present invention.

A schematic diagram showing illustrative components that may be used in device 10 and accessory 20 of system 8 is shown in FIG. 2. As shown in FIG. 2, electronic device 10 may include control circuitry 32 and input-output circuitry 34. Control circuitry 32 may include storage and processing circuitry that is configured to execute software that controls the operation of device 10. Control circuitry 32 may be implemented using one or more integrated circuits such as microprocessors, application specific integrated circuits, memory, and other storage and processing circuitry.

Input-output circuitry 34 may include components for receiving input from external equipment and for supplying output. For example, input-output circuitry 34 may include user interface components for providing a user of device 10 with output and for gathering input from a user. As shown in FIG. 2, input-output circuitry 34 may include communications circuitry 36. Communications circuitry 36 may include wireless circuitry such as radio-frequency transceiver circuitry with a radio-frequency receiver and/or a radio-frequency transmitter. Radio-frequency transceiver circuitry in the wireless circuitry may be used to handle wireless signals in communications bands such as the 2.4 GHz and 5 GHz WiFi® bands, cellular telephone bands, and other wireless communications frequencies of interest. Communications circuitry 36 may also include wired communications circuitry such as circuitry for communicating with external equipment over serial and/or parallel digital data paths.

Input-output devices 38 may include buttons such as sliding switches, push buttons, menu buttons, buttons based on dome switches, keys on a keypad or keyboard, or other switch-based structures. Input-output devices 38 may also include status indicator lights, vibrators, display touch sensors, speakers, microphones, camera sensors, ambient light sensors, proximity sensors, and other input-output structures.

Electronic device 10 may be coupled to components in accessory 20 using cables such as cable 26 of accessory 20. Accessory 20 may include speakers such as a pair of speaker drivers 40 (e.g., a left speaker and a right speaker). If desired, accessory 20 may include more than one driver per earbud. For example, each earbud in accessory 20 may have a tweeter, a midrange driver, and a bass driver (as an example). Speaker drivers 40 may be mounted in earbuds or other earphone housings. The use of left and right earbuds to house respective left and right speaker drivers 40 is sometimes described herein as an example.

If desired, accessory 20 may include user input devices 42 such as buttons (see, e.g., the buttons associated with button controller 30 of FIG. 1), touch-based input devices (e.g., touch screens, touch pads, touch buttons), a microphone to gather voice input, and other user input devices.

To determine whether or not the earbuds in which speaker drivers 40 have been mounted are located in the ears of a user, accessory 20 may be provided with ear presence sensor structures 44. Ear presence sensor structures 44 may be configured to detect whether or not the earbuds (or other earphone units of accessory 20) have been placed in the ears of a user. Ear presence sensors may be formed from force sensors, from switches or other mechanical sensors, from capacitive sensors, from resistance-based sensors, from light-based sensors, and from acoustic-based sensors such as ultrasonic acoustic-based sensors (as examples). Control circuitry 45 in accessory 20 (e.g., storage and processing circuits formed from one or more integrated circuits or other circuitry) and/or control circuitry 32 of electronic device 10 may use information from ear presence sensor structures 44 in determining which actions should be automatically taken by device 10.

Figure 3:
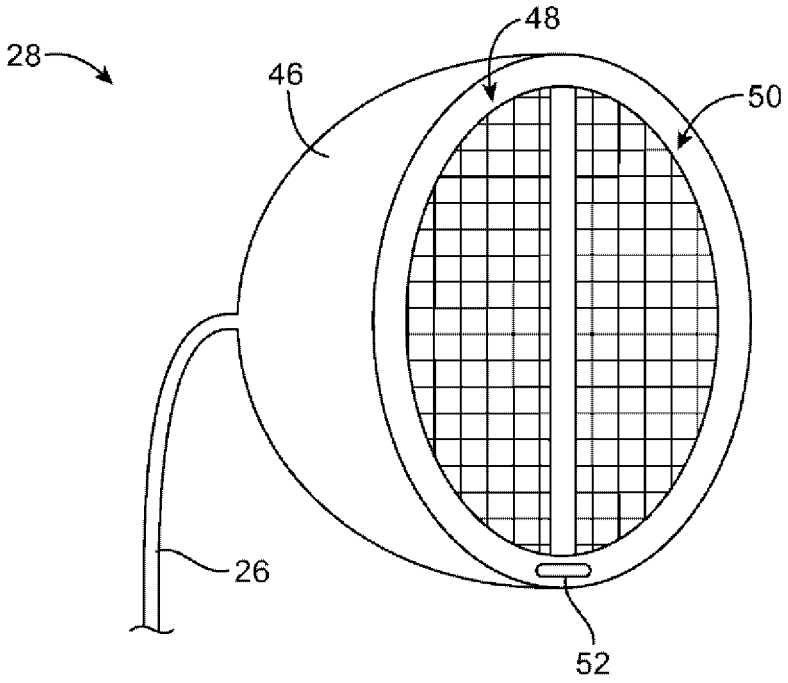
FIG. 3 is a perspective view of an illustrative earphone housing in an accessory in accordance with an embodiment of the present invention.

An illustrative earbud with an ear presence sensor is shown in FIG. 3. In the example of FIG. 3, earbud 28 has a housing such as housing 46 in which one or more speaker drivers such as speakers 40 of FIG. 2 are mounted. If desired, an auxiliary speaker such as speaker 52 may be mounted on the outside of housing 46 (e.g., to serve as a supplemental speaker for producing loud sounds when earbud 28 is not in the ear of a user). The supplemental speaker can be used to play back the same audio channel that is being played back by speakers 40 or may be used to support a multi-channel audio mode. For example, speakers 40 may be used to play bass and mid-range channel information (e.g., audio in a first frequency range), whereas supplemental speakers 52 may be used to play tweeter information (e.g., audio in a second frequency range that is higher than the first frequency range). As another example, speakers 40 may play right and left stereo information (and center channel information) and supplemental speakers 52 may play surround channel information.

Conductive structures such as conductive mesh structures 48 and 50 may be mounted in housing 46. As shown in FIG. 3, for example, mesh structures 48 and 50 may be mounted in the front of housing 46 so that sound from the speakers inside earbud housing 46 may pass through the holes of the mesh. If desired, earbud 28 may contain microphone structures (e.g., when implementing noise cancellation features in earbud 28). The use of mesh when forming electrode structures 48 and 50 may allow ambient sound to be picked up by the noise cancellation microphones in housing 46.

Mesh electrodes 48 and 50 (e.g., metal screen structures) or other conductive structures in earbud 28 may be used as first and second terminals in a resistive (resistance-based) sensor. Control circuitry in housing 46 may be used to apply a voltage across the first and second terminals while measuring how much current flows as a result. The control circuitry may use information on the voltage and current signals that are established between electrodes 48 and 50 to determine whether or not earbud 28 has been placed in the ear of a user. In the absence of the user's ear, the resistance between electrodes 48 and 50 will be relatively high. When, however, earbud 28 has been placed into a user's ear, contact between electrodes 48 and 50 and the flesh of the ear will give rise to a lower resistance path between electrodes 48 and 50. To determine whether or not earbud 28 has been placed within the user's ear, the control circuitry of earbud 28 (and/or control circuitry 32 of FIG. 2) may measure the resistance between electrodes 48 and 50 and may compare the measured resistance to a predetermined threshold. When the measured resistance is below the predetermined threshold, device 10 can conclude that earbud 28 has been placed in the ear of the user. When the measured resistance exceeds the predetermined threshold, device 10 can conclude that earbud 28 is out of the ear.

In addition to or instead of using mesh 48 and 50 to measure the resistance of the user's ear, mesh electrodes 48 and 50 may be used as capacitive sensor electrodes (e.g., to make mutual capacitance measurements or to make self capacitance measurements). Different capacitance values may be detected in the presence and absence of the user's ear in the vicinity of electrodes 48 and 50. This allows device 10 to use the capacitance measurements to determine whether or not earbud 28 is in or out of the user's ear.

Figure 4:
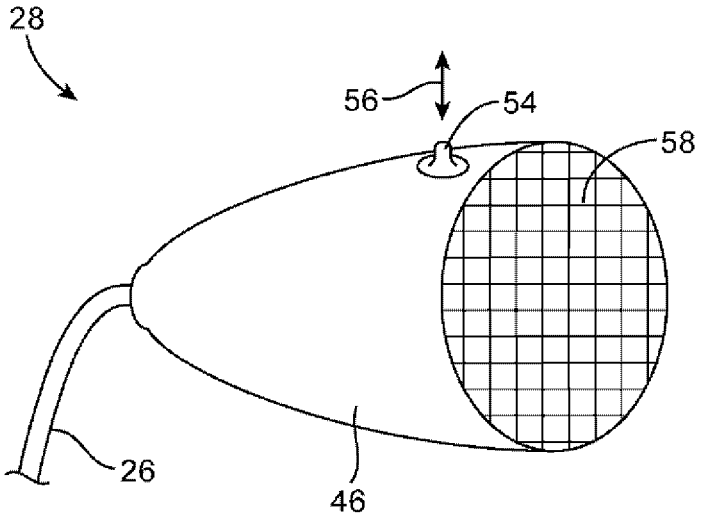
FIG. 4 is a perspective view of an illustrative earphone housing that has an ear presence sensor such as a switch in accordance with an embodiment of the present invention.

If desired, earbud 28 may be provided with a switch-based ear presence detector. As shown in FIG. 4, for example, switch 54 may be mounted on an exterior surface of earbud housing 46. Speaker mesh 58 may be mounted on the front of housing 46. Speaker drivers may be mounted within the interior of housing 46. During operation of earbud 28, sound may pass through openings in speaker mesh 58. Switch 54 may move up and down in directions 56. When earbud 28 is inserted in an ear of a user, switch 54 may be compressed inward. When earbud 28 is out of the user's ear, switch 54 may move outwards to regain its original uncompressed state. Device 10 may use information from switch structures such as switch 54 to determine whether or not earbud 28 has been placed in the ear of a user.

Figure 5:
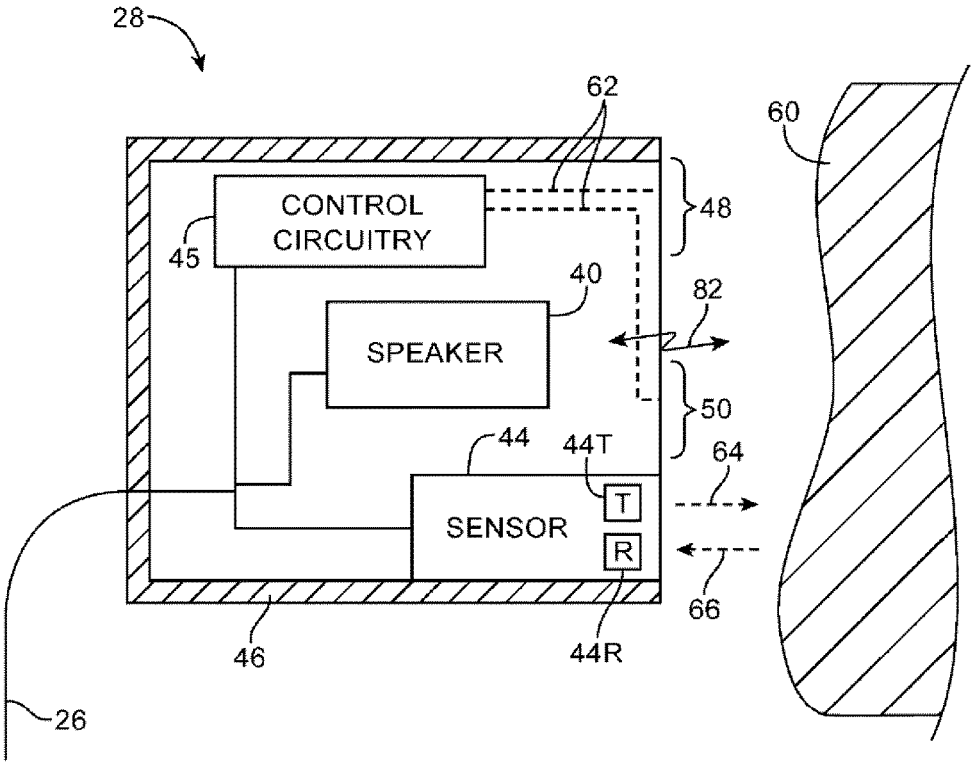
FIG. 5 is a cross-sectional side view of an earphone housing of the type that may be provided with sensor structures for detecting the presence of an ear or other external object in accordance with an embodiment of the present invention.

A cross-sectional side view of an illustrative earbud with a speaker driver and an associated ear presence sensor is shown in FIG. 5. As shown in FIG. 5, earbud 28 may have a housing such as housing 46. Speaker 40 may be mounted within housing 46 overlapping an acoustic grill formed from structures such as mesh 48 and 50 or other acoustic mesh. During operation, sound 82 may pass through the acoustic mesh. For example, speaker 40 may produce sound that is received by a user's ear or other external object 60.

When external object 60 is sufficiently close to earbud 28, the presence of external object 60 may be detected. For example, control circuitry 45 may measure the resistance between mesh electrodes 48 and 50 using conductive paths 62 or may use capacitance measurements in monitoring for the presence of object 60. The measured resistance (or capacitance) may then be used to determine whether earbud 28 is in the user's ear or is out of the user's ear. Control circuitry 45 may also use sensors such as sensor 44 of FIG. 5 to monitor for the presence or absence of external objects such as the user's ear. As shown in FIG. 5, sensor 44 may have a transmitter such as transmitter 44T and may have a receiver such as receiver 44R. During operation of sensor 44, sensor 44 may transmit signals such as signal 64 and may gather reflected signals such as signal 66. The strength of received signal 66 may be used to measure whether or not external object 60 is in the presence of earbud 28.

Sensor 44 may be a light-based sensor. For example, transmitter 44T may be a light-emitting diode or laser that emits light 64 (e.g., infrared light, visible light, etc.) and receiver 44R may be a light detector (e.g., a photodiode or phototransistor) that measures the amount of light 64 that is reflected as reflected light 66 from external object 60. When the amount of light that is reflected from external object 60 is high, device 10 can conclude that earbud 28 is in the user's ear. When the amount of light that is reflected from external object 60 is low, device 10 can conclude that earbud 28 is out of the user's ear.

If desired, sensor 44 may be a sensor that emits and receives acoustic signals. For example, transmitter 44T may be an ultrasonic signal transducer that transmits ultrasonic signals 64. Receiver 44R may be an ultrasonic signal receiver that measures the amount of corresponding ultrasonic signal 66 that is reflected from external object 60. When the amount of ultrasonic signal that is reflected from external object 60 is low, device 10 can conclude that earbud 28 is not in the user's ear. When the amount of ultrasonic signal that is reflected from external object 60 is high, device 10 can conclude that earbud 28 is currently in the user's ear.

In force-based sensor schemes, the resistance of a compressible foam may be measured or a strain gauge output can be monitored. When force is present, electronic device 10 can conclude that earbud 28 has been inserted into a user's ear, whereas when force is not present, electronic device 10 can conclude that earbud 28 has remained outside of the user's ear. Force indicative of a user's ear pressing against earbud 28 may also be monitored using piezo-electric force sensors or other force sensors.

Figure 6:
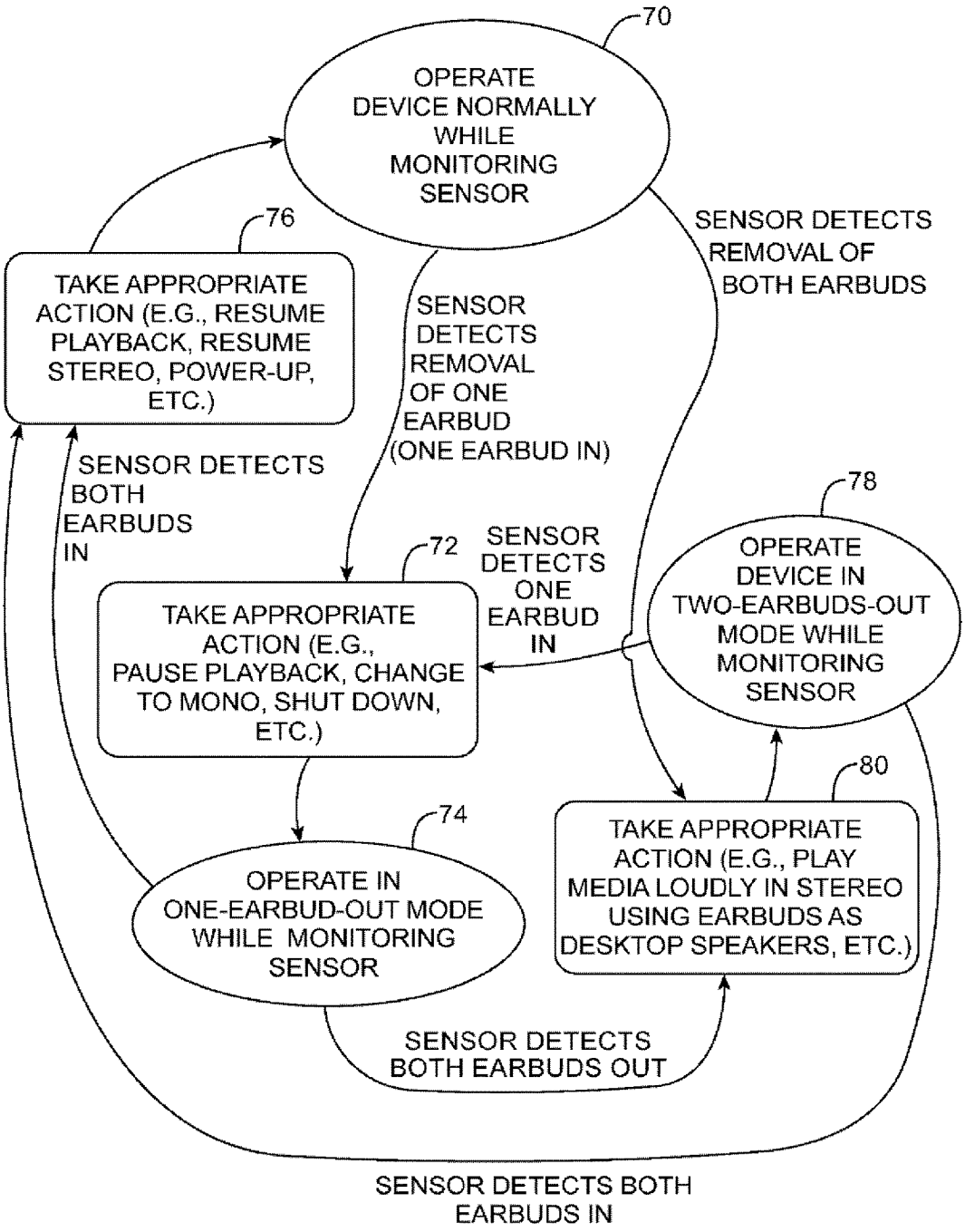
FIG. 6 is a flow chart of illustrative steps involved in using an accessory and electronic device in accordance with an embodiment of the present invention.

FIG. 6 is a flow chart of illustrative steps involved in using system 8. During the operations of step 70, earbuds 28 may be located in the ears of a user and device 10 may be operated normally while using sensor circuitry 44 to monitor for the presence or absence of each earbud 28 of accessory 20 within the ears of a user. Circuitry 32 (and/or circuitry 45, if desired) may be used in evaluating sensor data and taking appropriate action. Configurations in which control circuitry 32 is used in taking action based on sensor data are sometimes described herein as an example.

Examples of operations that may be performed by device 10 during step 70 include audio-based operations such as playing media content using an audio signal strength that results in a playback volume that is appropriate for listening through earbuds 28, providing a user with audio associated with a telephone call, providing audio associated with a video chat session to the user, or otherwise presenting audio content through earbuds 28. Audio may be played in stereo so that left and right earbuds receive corresponding left and right channels of audio, may be played using a multi-channel surround sound scheme, or may be played using a monophonic (mono) sound scheme in which both the left and right channels of audio are identical.

During the monitoring operation of step 70, device 10 can use ear presence detectors 44 to determine whether or not earbuds 28 remain within the user's ears. If it is determined that one of the earbuds has been removed so that only a single earbud remains in the ear of a user, device 10 can take appropriate action at step 72. For example, in response to determining that only one earbud remains in the user's ear, control circuitry 45 and/or 32 may automatically switch the type audio playback scheme that is being used from multi-channel or stereo sound to mono sound. Because only one earbud is being actively used, the use of a stereo playback scheme no longer is appropriate and could cause the user to miss information that is being sent to the channel associated with the absent earbud. As another example, if device 10 was playing music files, was playing video that includes audio, or was playing other audio content to the user, detection of removal of one earbud from the user's ear may indicate that the user has removed the earbud to allow the user to be able to better hear sounds in the user's environment (e.g., to converse with someone). Accordingly, in response to detection of removal of one of the earbuds from the user's ear, device 10 may automatically pause audio playback. Playback may also be completely stopped by device (e.g., by control circuitry 32) in response to detection of earbud removal (i.e., device 10 may perform the same type of stopping operation that would be performed in response to user selection of an on-screen stop option or user actuation of a stop button). Other actions may be taken in response to detection of removal of one earbud from the user's ear, if desired. These examples are merely illustrative.

Following the operations of step 72, control circuitry 30 may, at step 74 operate device 10 in a one-earbud-in mode while using ear presence detectors to monitor the state of each earbud. In particular, device 10 may operate in a mono audio mode or may operate in a mode in which audio playback has been paused or stopped (as examples). While operating device 10 in a one-earbud-in mode, control circuitry 32 and/or 45 may use ear presence sensor structures 44 to monitor for changes in the status of earbuds 28. If, during the operations of step 74, device 10 senses that the removed earbud has been returned to the user's ear so that both earbuds are inserted in the user's ears, appropriate action may be taken at step 76. For example, device 10 may switch the audio mode from mono to stereo (or other multi-channel audio mode), device 10 may resume the playback of paused or stopped audio content, etc. Operations may then proceed to step 70, where device 10 may operate in a two-earbud-in mode while monitoring ear presence sensor structures 44 to determine whether one or both earbuds have been removed from the user's ears.

If, during the operations of step 70, it is determined that both the left and right earbuds have been removed from the user's ears, device 10 may take suitable action at step 80. For example, in response to detecting that both earbuds are out of the user's ears, device 10 may conclude that the user is interested in using earbuds 28 as desk-top speakers. Because ear presence sensor structures 44 have confirmed that neither earbud is in the user's ear, device 10 can safely increase playback volume (i.e., audio signal drive strength) through the speakers to a loud level (e.g., a level that is in excess of a comfortable listening level for use when earbuds 28 are in the user's ears and that is sufficient to allow earbuds 28 to be used as regular non-earbud out-of-ear speakers). Both earbuds are in the same out-of-ear state, so audio may be played in stereo or other multi-channel formats may be used. As another example, device 10 can conclude that the user has removed earbuds 28 from the user's ear because the user temporarily is interested to listening to sounds in the user's surroundings and not the media that is being played through the earbuds. Device 10 can therefore pause or stop media playback.

After taking suitable actions at step 80, device 10 can be operated in a two-earbuds-out mode (step 78). For example, device 10 may use earbuds 28 as desktop speakers by playing music through earbuds 28 at a volume (audio signal drive strength) sufficient to be listened to comfortably by the user and potentially other listeners in the vicinity of earbuds 28 (i.e., at a normal music playback volume). If desired, an auxiliary speaker such as speaker 52 of FIG. 3 may be used as a supplemental speaker during audio playback in the two-earbuds-out mode. Supplemental speakers 52 may be used in playing multi-channel audio or may be used in playing high frequency audio or audio in another frequency range. As another example, device 10 may operate with paused or stopped audio playback during step 78.

During the operations of step 78, ear presence sensor structures 44 may be used to monitor for the presence of earbuds 28 in the ears of the user. If it is determined that one of the earbuds has been placed in the ear of the user, appropriate actions may be taken at step 72. For example, if device 10 was using earbuds 28 as desktop speakers by playing stereo audio loudly through earbuds 28 using a relatively high audio signal drive strength, device 10 may reduce the audio signal drive strength to a low level so that playback volume is reduced to a volume level that is acceptable for use of an earbud in the user's ear. Device 10 may also switch to a mono playback mode. If, during the operations of step 78, ear presence sensor structures 44 determine that both earbuds have been placed in the user's ears, appropriate action may be taken at step 76. For example, if device 10 was using earbuds 28 as desktop speakers, device 10 may reduce audio signal strength and therefore playback volume sufficiently to allow earbuds 28 to be safely used in the user's ears.

During the operations of step 74, sensor structures 44 may detect that both earbuds have been removed from the user's ears. In this situation, device 10 may take appropriate action at step 80. For example, device 10 may conclude that earbuds 28 are both not in the user's ears so that earbuds 28 may be safely used as desktop speakers. Playback volume may therefore be increased.

If desired, different audio amplifiers may be used for playback during earbud-in modes and earbud-out modes. For example, a low power audio amplifier that uses a low audio signal strength may be used to play audio through earbuds 28 when earbuds 28 are in the ears of the user and a high power audio amplifier that uses a high audio signal strength may be used by device 10 to play audio through earbuds 28 when earbuds 28 are both out of the user's ears.

The foregoing is merely illustrative of the principles of this invention and various modifications can be made by those skilled in the art without departing from the scope and spirit of the invention. The foregoing embodiments may be implemented individually or in any combination.

What is claimed is:

1. An electronic device, comprising:

a housing configured to be placed in a user's ear;

a speaker mounted in the housing;

a touch sensor on the housing;

a microphone in the housing; and a light-based sensor attached to the housing, wherein the light-based sensor comprises a light source and a light detector, wherein light emitted by the light source is reflected off of the user's ear and onto the light detector, and wherein audio playback through the speaker is paused in response to an amount of light that is reflected off of the user's ear and onto the light detector.

2. The electronic device defined in claim 1, further comprising:

storage and processing circuitry that includes at least one integrated circuit in the housing.

3. The electronic device defined in claim 1, wherein the light-based sensor detects whether the user's ear is present adjacent to the housing by measuring the amount of the light that is reflected off of the user's ear and onto the light detector.

4. The electronic device defined in claim 3, wherein audio playback through the speaker is resumed in response to the light-based sensor detecting that the user's ear is present adjacent to the housing.

5. An earphone configured to receive input from a user, the earphone comprising:

a housing;

a speaker in the housing;

storage and processing circuitry that includes at least one integrated circuit in the housing;

an input component in the housing that receives the input from the user and that adjusts audio playback through the speaker based on the input;

a microphone in the housing;

a light-based sensor in the housing, the light-based sensor comprising a light source that emits light onto the user and a light detector that receives at least a portion of the light that is reflected off of the user; and a mechanical sensor in the housing, wherein audio playback through the speaker is adjusted based on sensor data from the mechanical sensor and the light that is reflected off of the user and received by the light detector.

6. The earphone defined in claim 5, wherein the input component is a touch sensor.

7. The earphone defined in claim 5, further comprising:

an additional microphone in the housing, wherein at least one of the microphone and the additional microphone gathers voice input.

8. The earphone defined in claim 5, wherein the storage and processing circuitry pauses audio playback through the speaker in response to determining that the earphone is not in the ear of the user.

9. The earphone defined in claim 5, wherein the storage and processing circuitry initiates audio playback through the speaker in response to determining that the earphone is in the ear of the user.

10. Earphones comprising:

a speaker;

storage and processing circuitry comprising at least one integrated circuit;

a touch sensor that receives user input, wherein the touch sensor is a capacitive touch sensor, and wherein the storage and processing circuitry adjusts audio playback through the speaker in response to the user input;

a light-based sensor comprising a light source that emits light onto a user's ear and a light detector that receives at least a portion of the light that is reflected off of the user's ear; and a mechanical sensor, wherein audio playback through the speaker is adjusted based on sensor data from the mechanical sensor and the light that is reflected off of the user's ear and received by the light detector.

11. The earphones defined in claim 10, further comprising: a housing in which the speaker, the storage and processing circuitry, the touch sensor, the light-based sensor, and the mechanical sensor are mounted.

12. The earphones defined in claim 11, further comprising:

first and second microphones mounted in the housing.

* * * * *